US006525692B2

(12) United States Patent
Kim et al.

(10) Patent No.: US 6,525,692 B2
(45) Date of Patent: Feb. 25, 2003

(54) DUAL-BAND ANTENNA FOR MOBILE TELECOMMUNICATION UNITS

(75) Inventors: Jong Kyu Kim, Kyunggi-Do (KR); In Shig Park, Kyunggi-Do (KR); Ho Seok Seo, Kyunggi-Do (KR)

(73) Assignee: Korea Electronics Technology Institute, Kyunggi-Do (KR)

( * ) Notice: Subject to any disclaimer, the term of this patent is extended or adjusted under 35 U.S.C. 154(b) by 0 days.

(21) Appl. No.: 09/908,242

(22) Filed: Jul. 18, 2001

(65) Prior Publication Data

US 2002/0011966 A1 Jan. 31, 2002

Related U.S. Application Data

(63) Continuation-in-part of application No. 09/401,469, filed on Sep. 22, 1999, now Pat. No. 6,288,681.

(30) Foreign Application Priority Data

Sep. 25, 1998 (KR) ..... 1998-39926

(51) Int. Cl.[7] ..... H01Q 1/24
(52) U.S. Cl. ..... 343/702; 343/895
(58) Field of Search ..... 343/702, 725, 343/727, 853, 895, 900, 901, 893

(56) References Cited

U.S. PATENT DOCUMENTS 5,945,964 A * 8/1999 DeGroot et al. ..... 343/702
5,990,848 A * 11/1999 Annamaa et al. ..... 343/725
6,112,102 A * 8/2000 Zhinong ..... 455/550
6,288,681 B1 * 9/2001 Kim et al. ..... 343/702

FOREIGN PATENT DOCUMENTS

SE WO 97/30489 * 8/1997 ..... H01Q/1/36

* cited by examiner

*Primary Examiner*—Don Wong
*Assistant Examiner*—Shih-Chao Chen
(74) *Attorney, Agent, or Firm*—Katten Muchin Zavis Rosenman

(57) ABSTRACT

A dual-band antenna for mobile communication unit is provided with a support made of an insulating material, double stranded helical conductors, and a coaxial feeder connected to an end of each of the helical conductors. The double stranded helical conductors are wound in an identical direction on the support without intersecting each other to have different resonance frequencies, respectively, a winding region of the second helical conductor being a part of that of the first helical conductor. When a voltage is applied to the first and the second helical conductors through the coaxial feeder, the antenna operates in the optimum performance at two frequency bands. As a result, the unit can use a desired different mobile telecommunication service without changing it. Further, the inventive antenna is designed to be small in size to thereby allow it to be adapted on the mobile telecommunication unit.

5 Claims, 7 Drawing Sheets

$f$=850MHz f=1.8GHz

DUAL-BAND ANTENNA FOR MOBILE TELECOMMUNICATION UNITS

CROSS REFERENCE TO RELATED APPLICATION

This application is a continuation-in-part application of U.S. Ser. No.09/401,469 filed on Sep. 22, 1999, now U.S. Pat. No. 6,288,681, which claims priorities thereon pursuant to 35 USC 120.

FIELD OF THE INVENTION

The present invention relates to an antenna for transmitting and receiving radio frequency signals; and, more particularly, to a dual-band antenna for mobile telecommunication units, capable of operating in two frequency bands.

BACKGROUND OF THE INVENTION

Nowadays, a variety of mobile telecommunication services is being commercially offered all over the world. While some of these mobile telecommunication services utilize a same frequency band by employing different modulating systems, the majority of these mobile telecommunication services in general utilizes frequency bands different from each other as exemplified by the cellular system and the personal communication system(PCS), the cellular system and the PCS system utilizing a frequency band of 824 to 894 MHz and 1.75 to 1.87 GHz, respectively.

A retractable antenna, in which a monopole antenna and a helical antenna are joined to each other and which is contractibly mounted on an upper portion of a mobile phone unit, is most widely used.

When the retractable antenna is extended out from the mobile unit, the monopole antenna operates independently or together with the helical antenna to transmit and receive a signal of a desired frequency band. When it is contracted in the mobile unit, only the helical antenna operates.

This retractable antenna, while suitable for operating only in one frequency band, is unsuitable for use in two or more different mobile telecommunication services, each telecommunication service operating in a different frequency band, while maintaining a desired radiation pattern. The reasons are as follows: Firstly, in order to make it possible for the antenna to operate at the frequency bands of both of the cellular system and the PCS, a complex matching circuit must be realized, matching a part or all of the bands, since a bandwidth between the cellular system and the PCS is in the neighborhood of 1 GHz; secondly, it is difficult to use one antenna for two different frequency bands since the central frequency of one mobile telecommunication frequency band is not a multiple of the harmonic component of that of the other mobile telecommunication frequency band; and thirdly, even if the antenna has been matched for use in two or more frequency bands, it is often difficult to realize a desired radiation pattern with the antenna at each of the frequency bands. In other words, in order to be serviced by a mobile telecommunication service, it is desirable for the customer to have a mobile phone unit designed for that particular frequency band thereof.

Therefore, in order to alleviate such a problem, a mobile phone unit, and hence, the parts therefor, capable of being used in mobile telecommunication services operating at different frequency bands, is desired.

There is shown in FIG. 1 a conventional dual-band helical antenna which operates in two frequency bands. As shown, the dual-band helical antenna includes a support 120 made of an insulating material and coils 130 and 140 wound on an upper part 100 and a lower part 110 of the support 120, respectively, thereby forming two helical antenna sections. The helical antenna sections are designed to have different resonance frequencies, respectively. Further, an inner portion of the support 120 is provided with a coaxial line. The number and a pitch of the windings and a length of a coil wound on a helical antenna section are different from those for the other helical antenna section in such a way that the two helical antenna sections are provided with two different resonance frequencies.

Therefore, when a voltage is applied through a coaxial line in the support 120, two helical antenna sections resonate at two different frequency bands, respectively.

However, the above described antenna has a shortcoming in that since the helical antenna is divided into the upper part and the lower part of the support, it is rather bulky and hence occupies a large space in the mobile phone unit, thereby posing an obstacle to current trend in mobile phone design of downsizing, i.e., to make the phone as light and as small as possible.

SUMMARY OF THE INVENTION

It is, therefore, an object of the present invention to provide a dual-band antenna for mobile telecommunication units capable of operating in two frequency bands.

Another object of the present invention is to provide a dual-band antenna for mobile communication units which is small in size.

In accordance with the present invention, there is provided a dual-band antenna for mobile communication units comprising a support made of an insulating material; double stranded helical conductors wound in an identical direction on the support without intersecting each other to have a first and a second resonance frequencies, respectively, a winding region of the second helical conductor being a part of that of the first helical conductor; and a coaxial feeder connected to an end of each of the helical conductors and for applying a voltage thereto.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
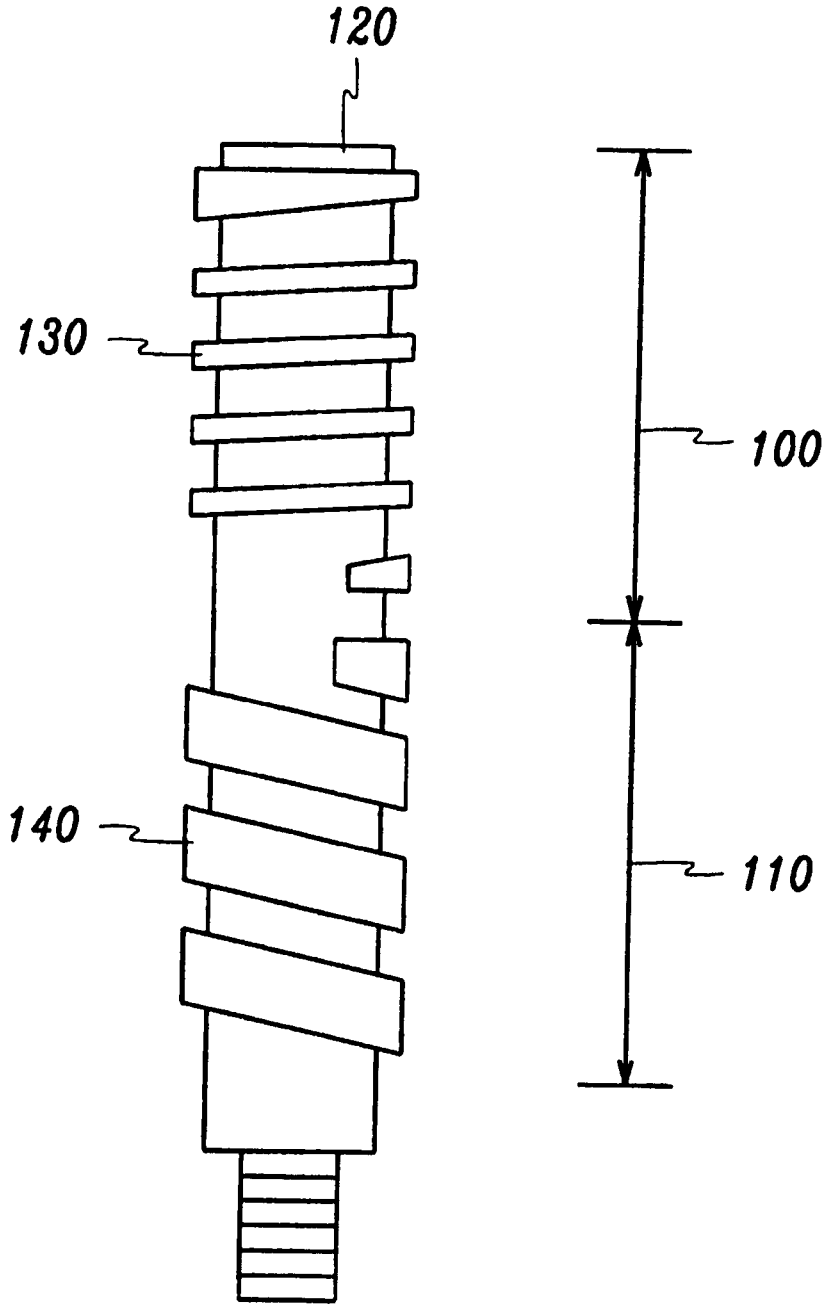
FIG. 1 (PRIOR ART)
FIG. 1 represents a cross sectional view of a conventional dual-band antenna.
Figure 2A:
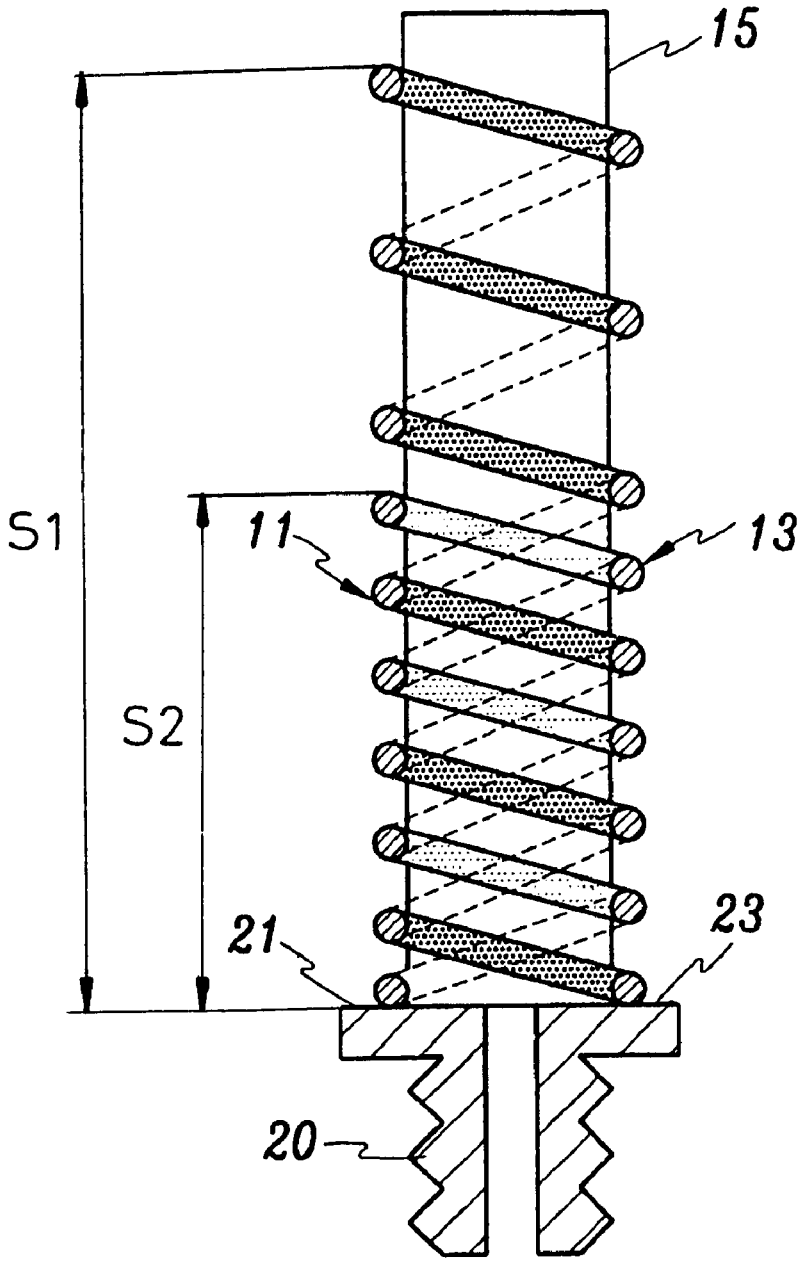
FIGS. 2A and 2B depict cross sectional views of a dual-band antenna for mobile telecommunication units in accordance with a first embodiment of the present invention.
Figure 2B:
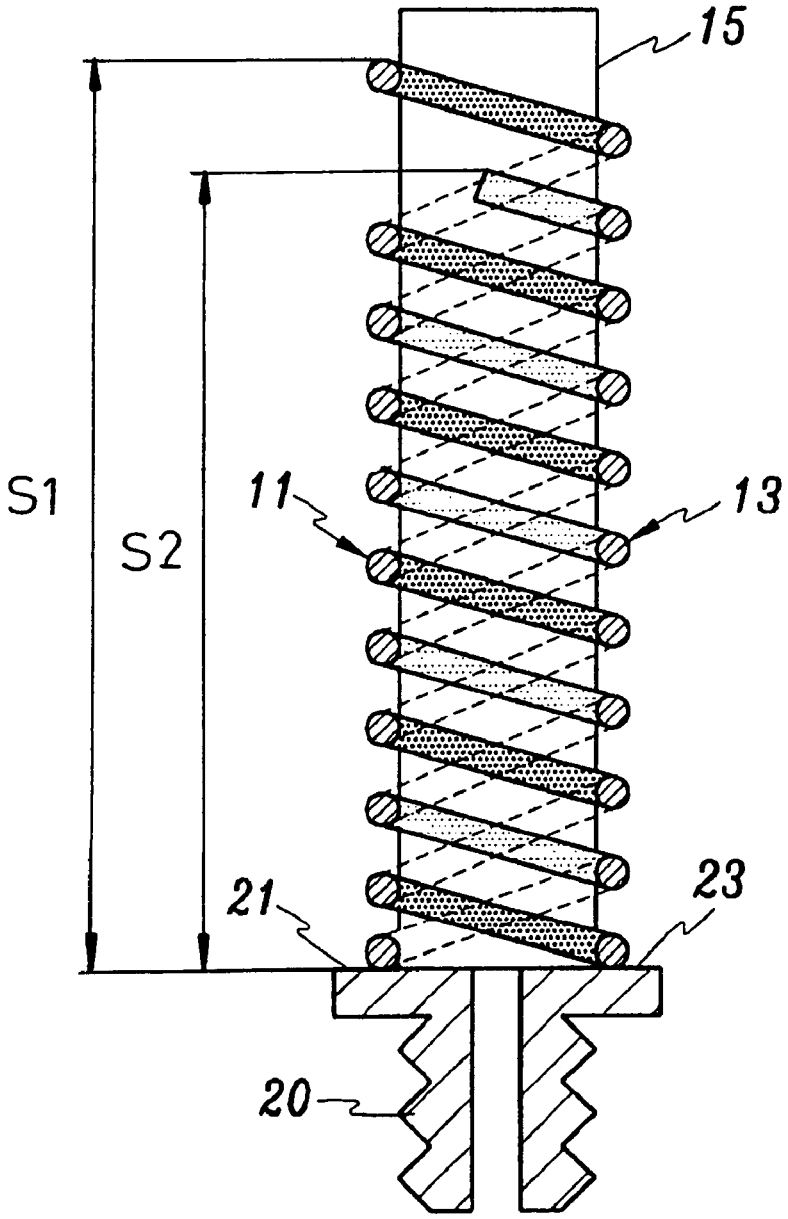

There is shown in FIGS. 2A and 2B a dual-band antenna for mobile telecommunication units in accordance with a first preferred embodiment of the present invention. As shown, the inventive dual-band antenna includes a support 15 made of an insulating material, double stranded helical conductors 11 and 13, and a coaxial feeder 20.

The first and the second helical conductors 11 and 13 wound in an identical direction on the support 15 without intersecting each other to have a first resonance frequency and a second resonance frequency, respectively. In accordance with the first preferred embodiment of the invention, the winding region S2 of the second helical conductor 13 is a part of the winding region S1 of the first helical conductor 11. Therefore, an axial length of the first helical conductor 11 is greater than that of the second helical conductor 13. Further, since the helical conductors 11 and 13 are wound in a form of a first and a second helix around the periphery of the support 15 having a constant diameter, diameters of the first and the second helix are identical to each other and pitches thereof are substantially same as shown in FIGS. 2A and 2B.

The coaxial feeder 20 is connected to an end of each of the helical conductors 11 and 13 for applying a voltage thereto. Further, the other end of the first helical conductor 11 is connected to a first feeder distribution center 21, while the other end of the second helical conductor 13 is connected to a second feeder distribution center 23.

The respective lengths and the respective winding numbers of the helical conductors 11 and 13 are basically a multiple of $\lambda/8$, but may be slightly changed due to an interaction thereof and the respective resonance frequencies of the helical conductors 11 and 13 are determined by the respective lengths and the respective winding numbers thereof.

Accordingly, a large difference in the lengths and the winding numbers of the helical conductors 11 and 13 as shown in FIG. 2A, will result in a correspondingly large difference in the resonance frequencies thereof, and vice versa as shown in FIG. 2B.

Therefore, in case of manufacturing an antenna capable of operating in two different frequency bands, the length and the winding number of each of the helical conductors are designed to resonate at respective corresponding frequencies, while in case of one frequency band, the length and the winding number of each thereof are constructed to be substantially equal to each other.

Further, the length and the winding number of each of the helical conductors are adjusted depending on a dielectric constant of the support 15 used in such a way that each of the helical conductors 11 and 13 resonates a different frequency band.

A voltage, applied through a matching circuit(not shown) of the antenna as described above to a coaxial feeder 20, is applied to the helical conductors connected thereto, thereby allowing the helical conductors to resonate at different frequencies.

Figure 4:
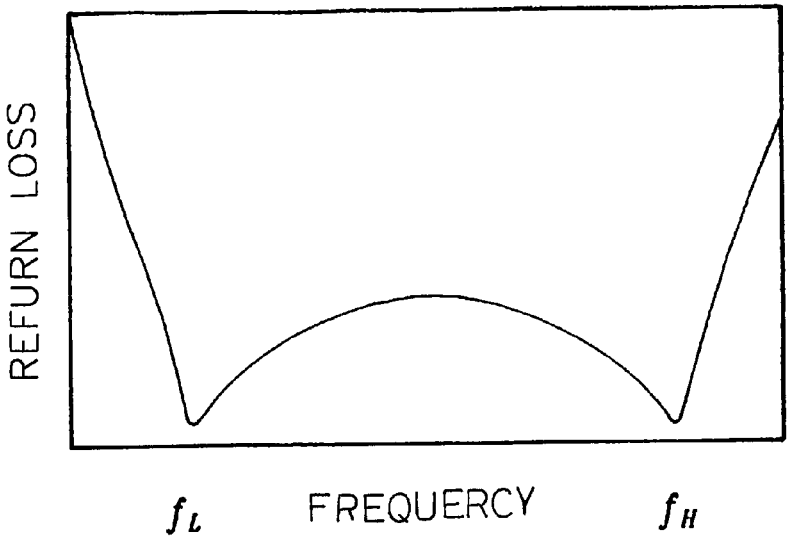
FIG. 4 demonstrates a graph for showing a characteristic of the inventive antenna for mobile telecommunication units.

As best shown in FIG. 4, the inventive antenna including the above helical conductors 11 and 13 can be operated in two different frequency bands, thereby extending a frequency bandwidth, as a result of a return loss value at the respective resonate frequencies, referred herein as, $f_H$ and $f_L$, becoming minimum. It is of course that the present invention may be obtained by using two coils wound in the same direction on a support made of an insulating material, by using two coils wound in the same direction in air, or by using a metallic pattern such as two coils on a dielectric body, ceramic body and the like.

Figure 3A:
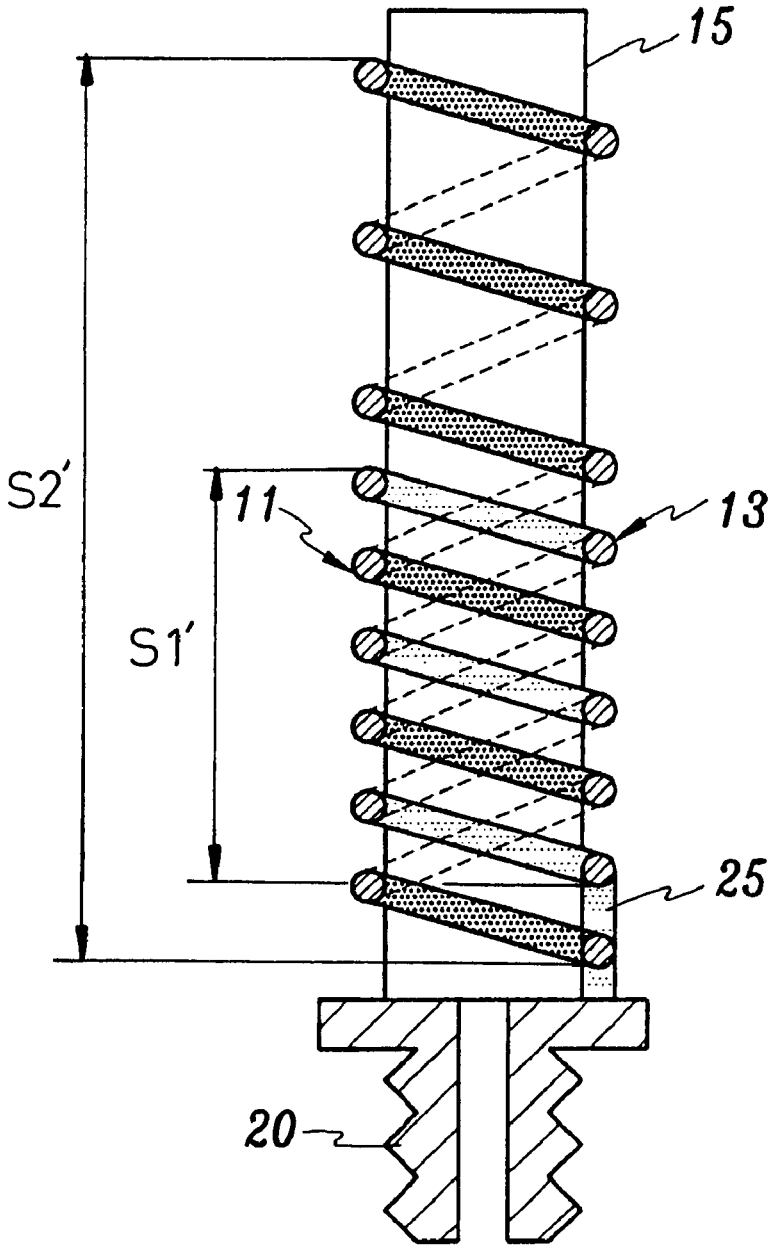
FIGS. 3A and 3B set forth cross sectional views of a dual-band antenna for mobile telecommunication units in accordance with a second embodiment of the present invention.
Figure 3B:
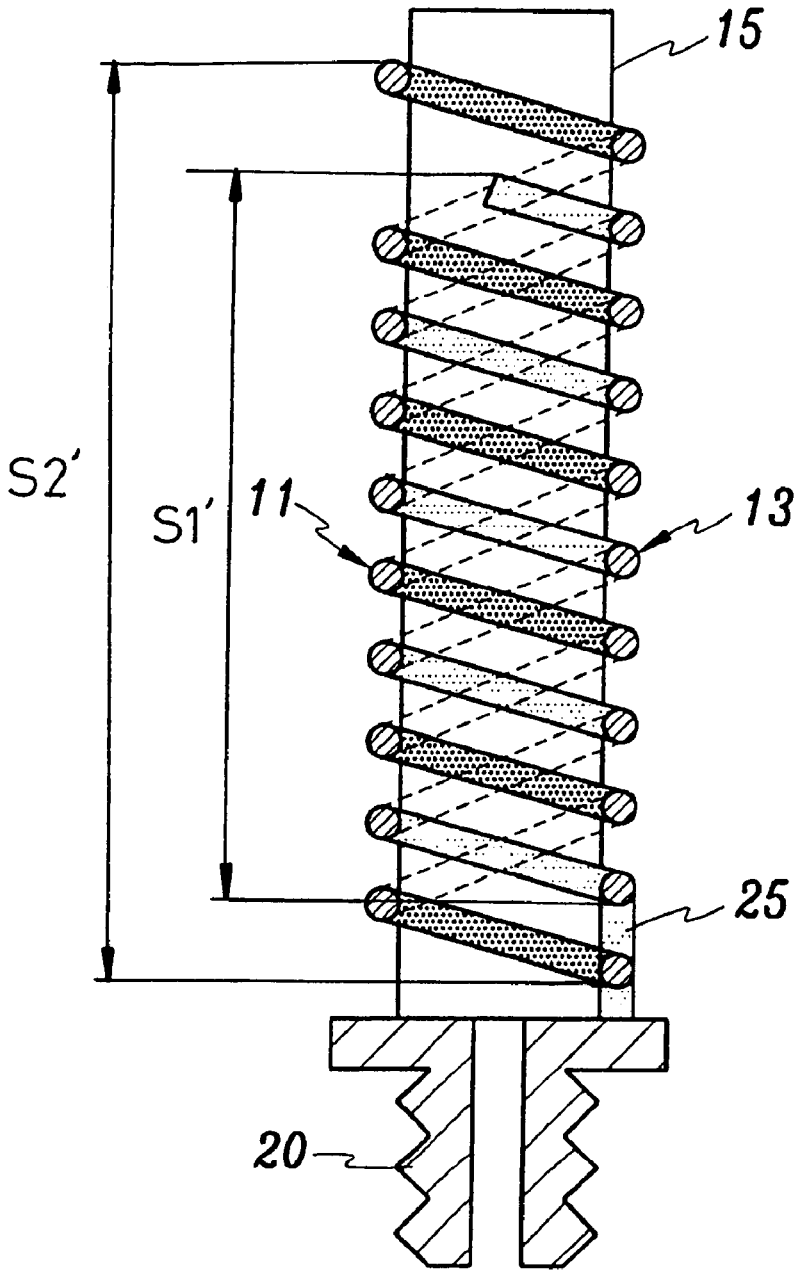

There is shown in FIGS. 3A and 3B a double stranded dual-band antenna in accordance with a second embodiment of the present invention. This embodiment is similar to the first embodiment as described above except that an identical feeder distribution center 25 of the coaxial feeder 20 is used to allow an end of each of the helical conductors 11 and 13 to be connected thereto so that a voltage can be applied to the helical conductors through the identical feeder distribution center 25. As shown in FIGS. 3A and 3B, the winding region S2' of the second helical conductor 13 is a part of the winding region S1' of the first helical conductor 11.

In this embodiment, a current distribution between the helical conductors 11 and 13 has a small phase difference, thereby preventing a performance of the antenna from degrading.

For example, in order to be used in both of the cellular system and the PCS as a mobile telecommunication commercialized, the helical conductors 11 and 13 are manufactured using the following table 1 such that the first helical conductor 11 resonates to 850 MHz of the frequency of the cellular system and the second helical conductor 13 resonates to 1.8 GHz of that of the PCS.

TABLE 1

| | Frequency | Radius | Winding Number | height |
|---|---|---|---|---|
| First helical conductor | 850 MHz | 2.5 mm | 10 | 11.6 mm |
| Second helical conductor | 1.8 GHz | 2.5 mm | 7.7 | 9.0 mm |

In Table 1, the helical conductors 11 and 13 are made of copper wire having a diameter of 0.4 mm. The helical antenna manufactured using the values disclosed in Table 1 is mounted on a unit having a right-angled hexahedral shape of 120 mm(height)×50 mm(width)×20 mm(length). Further, a power feeding is accomplished by using a coaxial line.

The radiation characteristics of the helical antenna as described above are shown in FIGS. 5A and 5B. It is preferable for the antenna to be omnidirectional since customer's position is generally not fixed in one direction with respect to a base station. It is, however, impossible to obtain an antenna having an isotropic radiation pattern over the three dimensional space. Consequently, the radiation pattern of the antenna in the three dimensional space is designed to have a doughnut-shaped radiation characteristic.

Figure 5A:
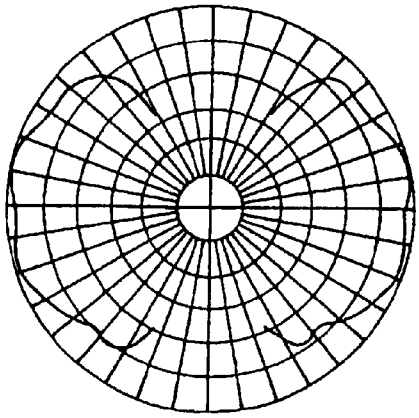
FIGS. 5A and 5B provide a radiation pattern of the inventive antenna for mobile telecommunication units.
Figure 5B:
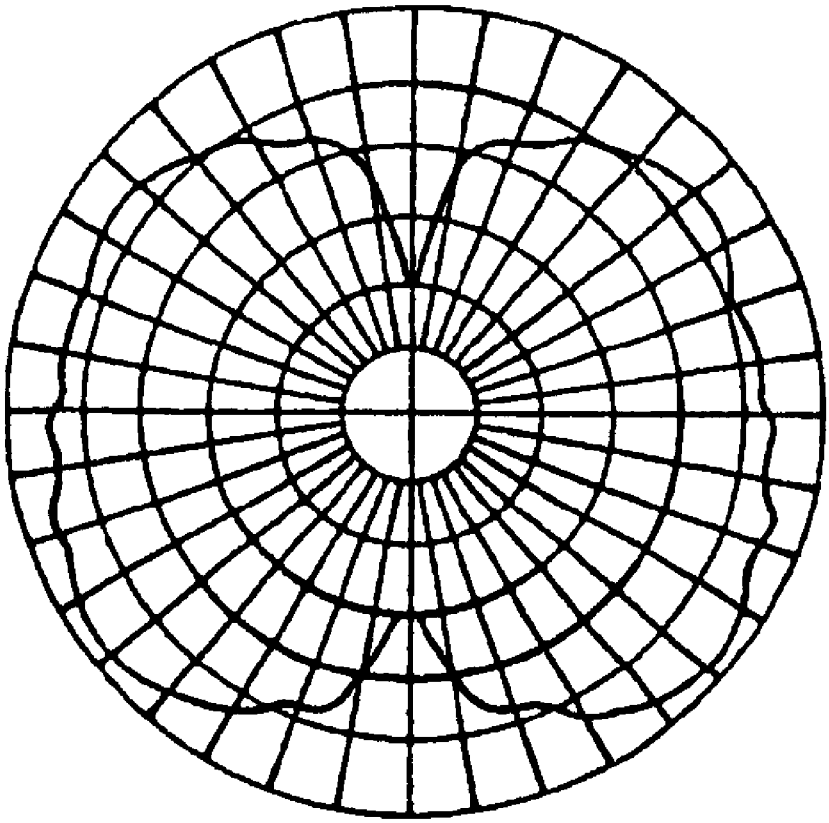

The radiation patterns obtained from a helical antenna which is manufactured using the values disclosed in Table 1, the values being obtained through a simulation performed by using IE3D manufactured by Zeland and HFSS by HP, are shown in FIGS. 5A and 5B.

The radiation characteristic of an inventive helical antenna is in the form of a butterfly at 850 MHz of frequency as shown in FIG. 5A, and, likewise, at 1.8 GHz of frequency as shown in FIG. 5B. Accordingly, by using two helical conductors having different lengths, respectively, it is possible to provide an antenna capable of being operated in two frequency bands and having an optimum performance.

As described above, since the inventive dual-band antenna is small in size while preserving its performance, it can be used in accelerating the miniaturization of the mobile telecommunication units.

Further, by using the dual-band antenna of the present invention, the customer can make use of more than one mobile telecommunication services without changing the mobile phone unit.

While the invention has been shown and described with respect to the preferred embodiments, it will be understood by those skilled in the art that various changes and modifications may be made without departing from the spirit and scope of the invention as defined in the following claims.

What is claimed is:

1. A dual-band antenna for mobile communication units comprising:

a support made of an insulating material;

double stranded helical conductors in a form of a first and a second helix wound in a identical direction on the support without intersecting each other to have the first and a second resonance frequencies, respectively, wherein a winding region of the second helix is a part of that of the first helix and diameters of the first and the second helix are identical; and a coaxial feeder connected to an end of each of the helical conductors and for applying a voltage thereto.

2. The dual-band antenna of claim 1, wherein the coaxial feeder includes a first and a second feeder distribution centers and the first and the second helical conductors are connected to the first and the second feeder distribution centers, respectively.

3. The dual-band antenna of claim 1, wherein the coaxial feeder is of one feeder distribution center and the helical conductors are connected to the feeder distribution center.

4. The dual-band antenna of claim 1, wherein an axial length of the first helix is greater than that of the second helix.

5. The dual-band antenna of claim 1, wherein pitches of the first and the second helix are substantially identical.

* * * * *